US009328479B1

(12) United States Patent
Rausch et al.

(10) Patent No.: US 9,328,479 B1
(45) Date of Patent: May 3, 2016

(54) GRADE CONTROL SYSTEM AND METHOD FOR A WORK VEHICLE

(71) Applicant: Deere & Company, Moline, IL (US)

(72) Inventors: Bryan Rausch, Durango, IA (US); Christopher R. Benson, Dubuque, IA (US); Scott S. Hendron, Dubuque, IA (US); Travis Wiens, Saskatoon (CA); Jeff Dobchuk, Saskatoon (CA); George W. Bozdech, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 14/614,505

(22) Filed: Feb. 5, 2015

(51) Int. Cl.
*E02F 3/76* (2006.01)
*E02F 3/84* (2006.01)

(52) U.S. Cl.
CPC ..... *E02F 3/845* (2013.01); *E02F 3/7618* (2013.01); *E02F 3/844* (2013.01)

(58) Field of Classification Search
CPC ..... E02F 3/845; E02F 3/844; E02F 3/7618; G01S 19/14
See application file for complete search history.

(56) References Cited

U.S. PATENT DOCUMENTS 2,941,319 A 6/1960 Beemer et al.
4,157,118 A * 6/1979 Suganami ..... E02F 3/845 172/12
4,535,847 A 8/1985 Hasegawa et al.
4,962,816 A * 10/1990 Imon ..... E02F 3/7613 172/821
5,462,125 A 10/1995 Stratton et al.
5,499,684 A 3/1996 Stratton
5,551,518 A 9/1996 Stratton
5,631,658 A * 5/1997 Gudat ..... A01B 79/005 342/357.31
5,862,868 A 1/1999 Yamamoto et al.
5,964,298 A * 10/1999 Greenspun ..... E02F 3/842 172/4.5
5,987,371 A 11/1999 Bailey et al.
6,035,241 A 3/2000 Yamamoto
6,112,145 A 8/2000 Zachman
6,164,117 A 12/2000 Passwater et al.

(Continued)

FOREIGN PATENT DOCUMENTS

DE 2923030 A * 12/1980
EP 1118719 A2 7/2001

OTHER PUBLICATIONS

Earthmoving Report: Cat K2 Dozers Offer Finely Tuned Finish Grading. Earthmoving Report [online]. Feb. 28, 2012. [retrieved on May 19, 2014] http://www.constructionequipment.com/earthmoving-report-cat-K2-dozers-offer-finely-tuned-finish-grading.

(Continued)

*Primary Examiner* — Michael J Zanelli

(57) ABSTRACT

A work vehicle may include a chassis, a ground-engaging blade, a sensor assembly, and a controller. The blade may be movably connected to the chassis via a linkage assembly configured to allow the blade to be raised and lowered relative to the chassis. The sensor assembly may be configured to provide a chassis inclination signal indicative of an angle of the chassis relative to the direction of gravity and a blade inclination signal indicative of an angle of the blade relative to one of the chassis and the direction of gravity. The controller may be configured to receive the chassis and blade inclination signals, determine a target grade, determine a distance error based on the signals indicative of a distance between the blade and the target grade, and send a command to move the blade toward the target grade based on the distance error.

17 Claims, 6 Drawing Sheets

(56) References Cited

U.S. PATENT DOCUMENTS

| | | | |
|---|---|---|---|
| 6,269,885 | B1 | 8/2001 | Barber et al. |
| 6,609,315 | B1 | 8/2003 | Hendron et al. |
| 6,757,994 | B1 | 7/2004 | Hendron |
| 6,763,619 | B2 | 7/2004 | Hendron et al. |
| 7,121,355 | B2 | 10/2006 | Lumpkins et al. |
| 7,206,681 | B2 | 4/2007 | Casey et al. |
| 7,317,977 | B2 | 1/2008 | Matrosov |
| 7,588,088 | B2 | 9/2009 | Zachman |
| 7,643,923 | B2 | 1/2010 | Buehlmann et al. |
| 8,060,299 | B2 | 11/2011 | Gharsalli et al. |
| 8,082,084 | B2 | 12/2011 | Nichols |
| 8,141,650 | B2 | 3/2012 | Breiner et al. |
| 8,145,391 | B2 | 3/2012 | Omelchenko et al. |
| 8,275,524 | B2 | 9/2012 | Krause et al. |
| 8,340,873 | B2 | 12/2012 | Finley et al. |
| 8,352,132 | B2 | 1/2013 | Omelchenko et al. |
| 8,406,963 | B2 | 3/2013 | Farmer et al. |
| 8,412,418 | B2 | 4/2013 | Kumagai et al. |
| 8,473,166 | B2 | 6/2013 | Zhdanov et al. |
| 8,594,879 | B2 | 11/2013 | Roberge et al. |
| 8,634,991 | B2 | 1/2014 | Douglas |
| 8,919,455 | B2 | 12/2014 | Hendron et al. |
| 2008/0087447 | A1 | 4/2008 | Piekutowski |
| 2008/0127530 | A1 | 6/2008 | Kelly |
| 2009/0112410 | A1 | 4/2009 | Shull |
| 2011/0153170 | A1 | 6/2011 | Dishman et al. |
| 2011/0169949 | A1 | 7/2011 | McCain et al. |
| 2011/0213529 | A1 | 9/2011 | Krause et al. |
| 2012/0059554 | A1 | 3/2012 | Omelchenko et al. |
| 2013/0080112 | A1 | 3/2013 | Friend |
| 2013/0158818 | A1 | 6/2013 | Callaway |
| 2014/0019013 | A1 | 1/2014 | Liu et al. |
| 2014/0207331 | A1* | 7/2014 | Kosarev ..... G05D 1/0891 701/34.4 |
| 2014/0343800 | A1* | 11/2014 | Nelson ..... G05B 23/00 701/49 |

OTHER PUBLICATIONS

Cat |New Cat® D6K2 Track—Type Tractor Offers Refined Blade Control and Enhanced . . . [online]. Apr. 2014. [retrieved on May 19, 2014] http://www.cat.com/en GB/news/press-release/new-cat-d6k2-tracktypetractoroffersrefine.

* cited by examiner

GRADE CONTROL SYSTEM AND METHOD FOR A WORK VEHICLE

FIELD OF THE DISCLOSURE

The present disclosure relates to machine. An embodiment of the present disclosure relates to a system and method for controlling the grade of a ground-engaging blade of a work vehicle.

BACKGROUND

Work vehicles with ground-engaging blades may be used to shape and smooth ground surfaces. Such work vehicles may be supported by wheels or tracks which may encounter high and low spots on the ground as the work vehicles move, which cause the work vehicle to pitch forwards (downwards) or backwards (upwards). This pitching may be transmitted to the ground-engaging blade, causing it to move upwards and downwards relative to the ground, which may move the blade off a designated or desired grade or plane. This effect may be amplified for those work vehicles with a ground engaging blade in front of the work vehicles' tires or tracks, as the work vehicle may pitch forwards or backwards as it encounters the vertical variations created by the ground-engaging blade due to earlier work vehicle pitching. If this effect goes uncorrected by an operator, it may create a "washboard" type surface on the ground or otherwise inhibit the creation of a smooth plane or grade on the ground.

SUMMARY

According to an aspect of the present disclosure, a work vehicle may include a chassis, a ground-engaging blade, a sensor assembly, and a controller. The blade may be movably connected to the chassis via a linkage assembly configured to allow the blade to be raised and lowered relative to the chassis. The sensor assembly may be configured to provide a chassis inclination signal indicative of an angle of the chassis relative to the direction of gravity and a blade inclination signal indicative of an angle of the blade relative to one of the chassis and the direction of gravity. The controller may be configured to receive the chassis inclination signal, receive the blade inclination signal, determine a target grade, determine a distance error based on the chassis inclination signal and the blade inclination signal indicative of a distance between the blade and the target grade, and send a command to move the blade toward the target grade based on the distance error.

According to another aspect of the present disclosure, the controller may be further configured to determine a first relative distance between a point on the linkage assembly and the target grade based on the chassis inclination signal, determine a second relative distance between a point on the blade and the point on the linkage assembly based on the blade inclination signal, and determine the distance error based on the first relative distance and the second relative distance.

According to another aspect of the present disclosure, the point on the linkage assembly is a point about which the blade vertically pivots relative to the chassis and the point on the blade is a point on a ground-engaging cutting edge of the blade.

According to another aspect of the present disclosure, the controller may be further configured to receive a target height indicative of a height above the target grade and determine the distance error based on the first relative distance, the second relative distance, and the target height.

According to another aspect of the present disclosure, the sensor assembly may be further configured to provide a chassis pitch signal indicative of a rotational velocity of the chassis in a pitch direction and the controller is further configured to send a command to move the blade toward the target grade based on the distance error and the chassis pitch signal.

According to another aspect of the present disclosure, the controller may be further configured to send a command to move the blade toward the target grade based on a first gain applied to the distance error and a second gain applied chassis pitch signal.

According to another aspect of the present disclosure, the sensor assembly may include a first sensor and a second sensor. The first sensor may be connected to the chassis at a fixed relative position to the chassis and configured to provide the chassis inclination signal. The second sensor may be connected to the blade at a fixed relative position to the blade and configured to provide the blade inclination signal.

According to another aspect of the present disclosure, at least one of the first sensor and the second sensor include at least one accelerometer and at least one gyroscope.

According to another aspect of the present disclosure, the controller may be further configured to determine the target grade based on a grade input by an operator.

According to another aspect of the present disclosure, the controller may be further configured to receive a blade command signal from an operator input and determine the target grade based on the chassis inclination signal and blade inclination signal after the most recent blade command signal.

According to another aspect of the present disclosure, the controller may be further configured to determine the target grade based on a signal from a satellite-based navigation system or a local positioning system.

According to another aspect of the present disclosure, a method of controlling a ground-engaging blade of a work vehicle may include receiving a chassis inclination signal indicative of an angle of a chassis of the work vehicle relative to the direction of gravity, receiving a blade inclination signal indicative of an angle of the blade relative to one of the chassis and the direction of gravity, determining a target grade, determining a distance error indicative of a distance between the blade and the target grade based on the chassis inclination signal and the blade inclination signal, and determining a command signal to direct movement of the blade toward the target grade based on the distance error.

According to another aspect of the present disclosure, the method may include determining a first relative distance between a point on a linkage assembly connecting the blade to the chassis and the target grade based on the chassis inclination signal, determining a second relative distance between a point on the blade and the point of the linkage assembly based on the blade inclination signal, and determining the distance between the point on the blade and the target grade based on the first relative distance and the second relative distance.

According to another aspect of the present disclosure, the distance error is not determined based on a signal received from a satellite navigation system.

According to another aspect of the present disclosure, a crawler-dozer may include a chassis, a ground-engaging blade, a hydraulic cylinder, an electrohydraulic valve assembly, a first sensor, a second sensor, and a controller. The blade may be movably connected to the chassis by a linkage assembly configured to allow the blade to be raised and lowered relative to the chassis. The electrohydraulic valve assembly may be configured to move the blade by directing hydraulic fluid to the hydraulic cylinder. The first sensor may be connected to the chassis at a fixed relative position to the chassis and configured to provide a chassis inclination signal indicative of an angle of the chassis relative to the direction of gravity. The second sensor may be connected to the blade at a fixed relative position to the blade and configured to provide a blade inclination signal indicative of an angle of the blade relative to one of the chassis and the direction of gravity. The controller may be configured to receive the chassis inclination signal, receive the blade inclination signal, determine a target grade, determine a distance error based on the chassis inclination signal, the blade inclination signal, and a kinematic relationship of the blade to the chassis, the distance error indicative of a distance between the blade and the target grade, determine a command signal directing movement of the blade toward the target grade based on the distance error, and send the command signal to the electrohydraulic valve assembly.

According to another aspect of the present disclosure, the controller may be further configured to determine a first relative distance between a point on the linkage assembly about which the blade vertically pivots relative to the chassis and the target grade based on the chassis inclination signal, determine a second relative distance between a point on a ground-engaging cutting edge of the blade and the point on the linkage assembly based on the blade inclination signal, and determine the distance error based on the first relative distance and the second relative distance.

According to another aspect of the present disclosure, the second sensor may be further configured to provide a chassis pitch signal indicative of a rotational velocity of the chassis in a pitch direction and the controller is further configured to send a command to move the blade toward the target grade based on the distance error and the chassis pitch signal.

According to another aspect of the present disclosure, the second sensor comprises at least one accelerometer and at least one gyroscope.

According to another aspect of the present disclosure, the controller may be further configured to receive a blade command signal from an operator input and determine the target grade based on the chassis inclination signal and blade inclination signal after the most recent blade command signal.

According to another aspect of the present disclosure, the controller may be configured to determine the distance error not based on a signal received from a satellite navigation system.

The above and other features will become apparent from the following description and accompanying drawings.

BRIEF DESCRIPTION OF THE DRAWINGS

The detailed description of the drawings refers to the accompanying figures in which.

Like reference numerals are used to indicate like elements throughout the several figures.

DETAILED DESCRIPTION

Figure 1:
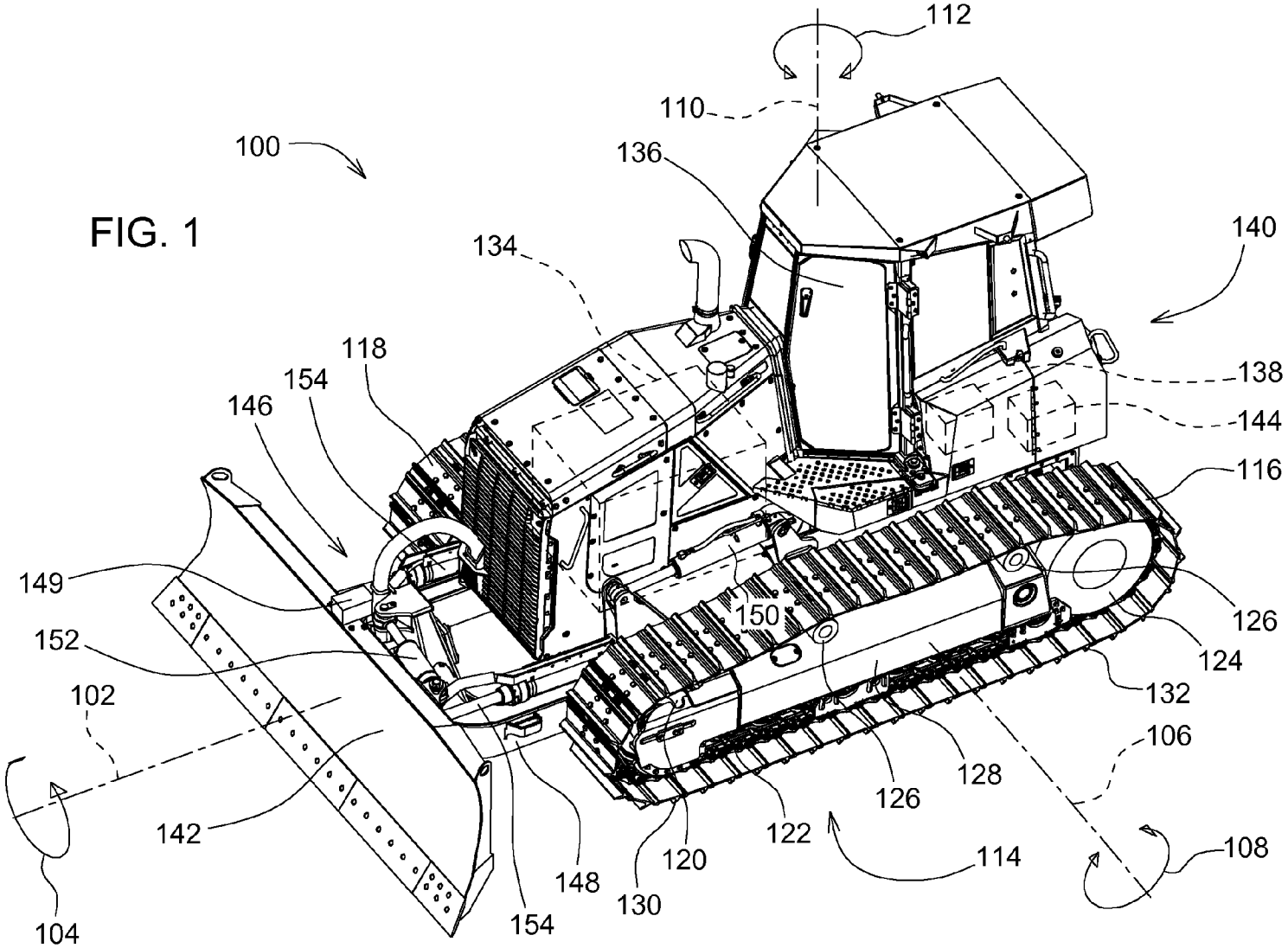
FIG. 1 is a perspective work of a work vehicle, for example a crawler dozer.

FIG. 1 is a perspective view of work vehicle 100. Work vehicle 100 is illustrated as a crawler dozer, which may also be referred to as a crawler, but may be any work vehicle with a ground-engaging blade or work implement such as a compact track loader, motor grader, scraper, skid steer, and tractor, to name a few examples. Work vehicle 100 may be operated to engage the ground and cut and move material to achieve simple or complex features on the ground. As used herein, directions with regard to work vehicle 100 may be referred to from the perspective of an operator seated within operator station 136: the left of work vehicle 100 is to the left of such an operator, the right of work vehicle 100 is to the right of such an operator, the front or fore of work vehicle 100 is the direction such an operator faces, the rear or aft of work vehicle 100 is behind such an operator, the top of work vehicle 100 is above such an operator, and the bottom of work vehicle 100 is below such an operator. While operating, work vehicle 100 may experience movement in three directions and rotation in three directions. Direction for work vehicle 100 may also be referred to with regard to longitude 102 or the longitudinal direction, latitude 106 or the lateral direction, and vertical 110 or the vertical direction. Rotation for work vehicle 100 may be referred to as roll 104 or the roll direction, pitch 108 or the pitch direction, and yaw 112 or the yaw direction or heading.

Work vehicle 100 is supported on the ground by undercarriage 114. Undercarriage 114 includes left track 116 and right track 118, which engage the ground and provide tractive force for work vehicle 100. Left track 116 and right track 118 may be comprised of shoes with grousers that sink into the ground to increase traction, and interconnecting components that allow the tracks to rotate about front idlers 120, track rollers 122, rear sprockets 124 and top idlers 126. Such interconnecting components may include links, pins, bushings, and guides, to name a few components. Front idlers 120, track rollers 122, and rear sprockets 124, on both the left and right sides of work vehicle 100, provide support for work vehicle 100 on the ground. Front idlers 120, track rollers 122, rear sprockets 124, and top idlers 126 are all pivotally connected to the remainder of work vehicle 100 and rotationally coupled to their respective tracks so as to rotate with those tracks. Track frame 128 provides structural support or strength to these components and the remainder of undercarriage 114.

Front idlers 120 are positioned at the longitudinal front of left track 116 and right track 118 and provide a rotating surface for the tracks to rotate about and a support point to transfer force between work vehicle 100 and the ground. Left track 116 and right track 118 rotate about front idlers 120 as they transition between their vertically lower and vertically upper portions parallel to the ground, so approximately half of the outer diameter of each of front idlers 120 is engaged with left track 116 or right track 118. This engagement may be through a sprocket and pin arrangement, where pins included in left track 116 and right track 118 are engaged by recesses in front idler 120 so as to transfer force. This engagement also results in the vertical height of left track 116 and right track 118 being only slightly larger than the outer diameter of each of front idlers 120 at the longitudinal front of left track 116 and right track 118. Frontmost engaging point 130 of left track 116 and right track 118 can be approximated as the point on each track vertically below the center of front idlers 120, which is the frontmost point of left track 116 and right track 118 which engages the ground. When work vehicle 100 encounters a ground feature when traveling in a forward direction, left track 116 and right track 118 may first encounter it at frontmost engaging point 130. If the ground feature is at a higher elevation than the surrounding ground surface (i.e., an upward ground feature), work vehicle 100 may begin pitching backward (which may also be referred to as pitching upward) when frontmost engaging point 130 reaches the ground feature. If the ground feature is at a lower elevation than the surrounding ground surface (i.e., a downward ground feature), work vehicle 100 may continue forward without pitching until the center of gravity of work vehicle 100 is vertically above the edge of the downward ground feature. At that point, work vehicle 100 may pitch forward (which may also be referred to as pitching downward) until frontmost engaging point 130 contacts the ground. In this embodiment, front idlers 120 are not powered and thus are freely driven by left track 116 and right track 118. In alternative embodiments, front idlers 120 may be powered, such as by an electric or hydraulic motor, or may have an included braking mechanism configured to resist rotation and thereby slow left track 116 and right track 118.

Track rollers 122 are longitudinally positioned between front idler 120 and rear sprocket 124 along the bottom left and bottom right sides of work vehicle 100. Each of track rollers 122 may be rotationally coupled to left track 116 or right track 118 through engagement between an upper surface of the tracks and a lower surface of track rollers 122. This configuration may allow track rollers 122 to provide support to work vehicle 100, and in particular may allow for the transfer of forces in the vertical direction between work vehicle 100 and the ground. This configuration also resists the upward deflection of left track 116 and right track 118 as they traverse an upward ground feature whose longitudinal length is less than the distance between front idler 120 and rear sprocket 124.

Rear sprockets 124 may be positioned at the longitudinal rear of left track 116 and right track 118 and, similar to front idlers 120, provide a rotating surface for the tracks to rotate about and a support point to transfer force between work vehicle 100 and the ground. Left track 116 and right track 118 rotate about rear sprockets 124 as they transition between their vertically lower and vertically upper portions parallel to the ground, so approximately half of the outer diameter of each of rear sprockets 124 is engaged with left track 116 or right track 118. This engagement may be through a sprocket and pin arrangement, where pins included in left track 116 and right track 118 are engaged by recesses in rear sprockets 124 so as to transfer force. This engagement also results in the vertical height of left track 116 and right track 118 being only slightly larger than the outer diameter of each of rear sprockets 124 at the longitudinal back or rear of left track 116 and right track 118. Rearmost engaging point 132 of left track 116 and right track 118 can be approximated as the point on each track vertically below the center of rear sprockets 124, which is the rearmost point of left track 116 and right track 118 which engages the ground. When work vehicle 100 encounters a ground feature when traveling in a reverse or backward direction, left track 116 and right track 118 may first encounter it at rearmost engaging point 132. If the ground feature is at a higher elevation than the surrounding ground surface, work vehicle 100 may begin pitching forward when rearmost engaging point 132 reaches the ground feature. If the ground feature is at a lower elevation than the surrounding ground surface, work vehicle 100 may continue backward without pitching until the center of gravity of work vehicle 100 is vertically above the edge of the downward ground feature. At that point, work vehicle 100 may pitch backward until rearmost engaging point 132 contacts the ground.

In this embodiment, each of rear sprockets 124 may be powered by a rotationally coupled hydraulic motor so as drive left track 116 and right track 118 and thereby control propulsion and traction for work vehicle 100. Each of the left and right hydraulic motors may receive pressurized hydraulic fluid from a hydrostatic pump whose direction of flow and displacement controls the direction of rotation and speed of rotation for the left and right hydraulic motors. Each hydrostatic pump may be driven by engine 134 of work vehicle 100, and may be controlled by an operator in operator station 136 issuing commands which may be received by controller 138 and communicated to the left and right hydrostatic pumps by controller 138. In alternative embodiments, each of rear sprockets 124 may be driven by a rotationally coupled electric motor or a mechanical system transmitting power from engine 134.

Top idlers 126 are longitudinally positioned between front idlers 120 and rear sprockets 124 along the left and right sides of work vehicle 100 above track rollers 122. Similar to track rollers 122, each of top idlers 126 may be rotationally coupled to left track 116 or right track 118 through engagement between a lower surface of the tracks and an upper surface of top idlers 126. This configuration may allow top idlers 126 to support left track 116 and right track 118 for the longitudinal span between front idler 120 and rear sprocket 124, and prevent downward deflection of the upper portion of left track 116 and right track 118 parallel to the ground between front idler 120 and rear sprocket 124.

Undercarriage 114 is affixed to, and provides support and tractive effort for, chassis 140 of work vehicle 100. Chassis 140 is the frame which provides structural support and rigidity to work vehicle 100, allowing for the transfer of force between blade 142 and left track 116 and right track 118. In this embodiment, chassis 140 is a weldment comprised of multiple formed and joined steel members, but in alternative embodiments it may be comprised of any number of different materials or configurations. Sensor 144 is affixed to chassis 140 of work vehicle 100 and configured to provide a signal indicative of the movement and orientation of chassis 140. In alternative embodiments, sensor 144 may not be affixed directly to chassis 140, but may instead be connected to chassis 140 through intermediate components or structures, such as rubberized mounts. In these alternative embodiments, sensor 144 is not directly affixed to chassis 140 but is still connected to chassis 140 at a fixed relative position so as to experience the same motion as chassis 140.

Sensor 144 is configured to provide a signal indicative of the inclination of chassis 140 relative to the direction of gravity, an angular measurement in the direction of pitch 108. This signal may be referred to as a chassis inclination signal. Controller 138 may actuate blade 142 based on this chassis inclination signal, as further described with regard to FIG. 2, FIG. 3, and FIG. 4. As used herein, "based on" means "based at least in part on" and does not mean "based solely on," such that it neither excludes nor requires additional factors. Sensor 144 may also be configured to provide a signal or signals indicative of other positions or velocities of chassis 140, including, its angular position, velocity, or acceleration in a direction such as the direction of roll 104, pitch 108, yaw 112, or its linear acceleration in a direction such as the direction of longitude 102, latitude 106, and vertical 110. Sensor 144 may be configured to directly measure inclination, measure angular velocity and integrate to arrive at inclination, or measure inclination and derive to arrive at angular velocity. The placement of sensor 144 on chassis 140 instead of on blade 142 or linkage 146 may allow sensor 144 to be better protected from damage, more firmly affixed to work vehicle 100, more easily packaged, or more easily integrated into another component of work vehicle 100 such as controller 138. This placement may allow for sensor 144 to be more cost effective, durable, reliable, or accurate than if sensor 144 were placed on blade 142 or linkage 146, even though placing sensor 144 directly on blade 142 or linkage 146 (such as sensor 149) may allow for a more direct reading of a position, velocity, or acceleration of those components.

Blade 142 is a work implement which may engage the ground or material to move or shape it. Blade 142 may be used to move material from one location to another and to create features on the ground, including flat areas, grades, hills, roads, or more complexly shaped features. In this embodiment, blade 142 of work vehicle 100 may be referred to as a six-way blade, six-way adjustable blade, or power-angle-tilt (PAT) blade. Blade 142 may be hydraulically actuated to move vertically up or vertically down (which may also be referred to as blade lift, or raise and lower), roll left or roll right (which may be referred to as blade tilt, or tilt left and tilt right), and yaw left or yaw right (which may be referred to as blade angle, or angle left and angle right). Alternative embodiments may utilize a blade with fewer hydraulically controlled degrees of freedom, such as a 4-way blade that may not be angled, or actuated in the direction of yaw 112.

Blade 142 is movably connected to chassis 140 of work vehicle 100 through linkage 146, which supports and actuates blade 142 and is configured to allow blade 142 to be raised or lowered relative to chassis 140 (i.e., moved in the direction of vertical 110). Linkage 146 may include multiple structural members to carry forces between blade 142 and the remainder of work vehicle 100 and may provide attachment points for hydraulic cylinders which may actuate blade 142 in the lift, tilt, and angle directions.

Linkage 146 includes c-frame 148, a structural member with a C-shape positioned rearward of blade 142, with the C-shape open toward the rear of work vehicle 100. Each rearward end of c-frame 148 is pivotally connected to chassis 140 of work vehicle 100, such as through a pin-bushing joint, allowing the front of c-frame 148 to be raised or lowered relative to work vehicle 100 about the pivotal connections at the rear of c-frame 148. The front portion of c-frame 148, which is approximately positioned at the lateral center of work vehicle 100, connects to blade 142 through a ball-socket joint. This allows blade 142 three degrees of freedom in its orientation relative to c-frame 148 (lift-tilt-angle) while still transferring rearward forces on blade 142 to the remainder of work vehicle 100.

Sensor 149 is affixed to blade 142 above the ball-socket joint connecting blade 142 to c-frame 148. Sensor 149, like sensor 144, may be configured to measure angular position (inclination or orientation), velocity, or acceleration, or linear acceleration. Sensor 149 may provide a blade inclination signal, which indicates the angle of blade 142 relative to gravity. In alternative embodiments, a sensor may be configured to instead measure an angle of linkage 146, such as an angle between linkage 146 and chassis 140, in order to determine a position of blade 142. In other alternative embodiments, sensor 149 may be configured to measure a position of blade 142 by measuring a different angle, such as one between linkage 146 and blade 142, or the linear displacement of a cylinder attached to linkage 146 or blade 142. In alternative embodiments, sensor 149 may not be affixed directly to blade 142, but may instead be connected to blade 142 through intermediate components or structures, such as rubberized mounts. In these alternative embodiments, sensor 149 is not directly affixed to blade 142 but is still connected to blade 142 at a fixed relative position so as to experience the same motion as blade 142.

Blade 142 may be raised or lowered relative to work vehicle 100 by the actuation of lift cylinders 150, which may raise and lower c-frame 148 and thus raise and lower blade 142, which may also be referred to as blade lift. For each of lift cylinders 150, the rod end is pivotally connected to an upward projecting clevis of c-frame 148 and the head end is pivotally connected to the remainder of work vehicle 100 just below and forward of operator station 136. The configuration of linkage 146 and the positioning of the pivotal connections for the head end and rod end of lift cylinders 150 results in the extension of lift cylinders 150 lowering blade 142 and the retraction of lift cylinders 150 raising blade 142. In alternative embodiments, blade 142 may be raised or lowered by a different mechanism, or lift cylinders 150 may be configured differently, such as a configuration in which the extension of lift cylinders 150 raises blade 142 and the retraction of lift cylinders 150 lowers blade 142.

Blade 142 may be tilted relative to work vehicle 100 by the actuation of tilt cylinder 152, which may also be referred to as moving blade 142 in the direction of roll 104. For tilt cylinder 152, the rod end is pivotally connected to a clevis positioned on the back and left sides of blade 142 above the ball-socket joint between blade 142 and c-frame 148 and the head end is pivotally connected to an upward projecting portion of linkage 146. The positioning of the pivotal connections for the head end and the rod end of tilt cylinder 152 result in the extension of tilt cylinder 152 tilting blade 142 to the left or counterclockwise when viewed from operator station 136 and the retraction of tilt cylinder 152 tilting blade 142 to the right or clockwise when viewed from operator station 136. In alternative embodiments, blade 142 may be tilted by a different mechanism (e.g., an electrical or hydraulic motor) or tilt cylinder 152 may be configured differently, such as a configuration in which it is mounted vertically and positioned on the left or right side of blade 142, or a configuration with two tilt cylinders.

Blade 142 may be angled relative to work vehicle 100 by the actuation of angle cylinders 154, which may also be referred to as moving blade 142 in the direction of yaw 112. For each of angle cylinders 154, the rod end is pivotally connected to a clevis of blade 142 while the head end is pivotally connected to a clevis of c-frame 148. One of angle cylinders 154 is positioned on the left side of work vehicle 100, left of the ball-socket joint between blade 142 and c-frame 148, and the other of angle cylinders 154 is positioned on the right side of work vehicle 100, right of the ball-socket joint between blade 142 and c-frame 148. This positioning results in the extension of the left of angle cylinders 154 and the retraction of the right of angle cylinders 154 angling blade 142 rightward, or yawing blade 142 clockwise when viewed from above, and the retraction of left of angle cylinder 150 and the extension of the right of angle cylinders 154 angling blade 142 leftward, or yawing blade 142 counterclockwise when viewed from above. In alternative embodiments, blade 142 may be angled by a different mechanism or angle cylinders 154 may be configured differently.

Due to the geometry of linkage 146 in this embodiment, blade 142 is not raised or lowered in a perfectly vertical line with respect to work vehicle 100. Instead, a point on blade 142 would trace a curve as blade 142 is raised and lowered. This means that the vertical component of the velocity of blade 142 is not perfectly proportional to the linear velocity with which lift cylinders 150 are extending or retracting, and the vertical component of blade 142's velocity may vary even when the linear velocity of lift cylinders 150 is constant. This also means that lift cylinders 150 have a mechanical advantage which varies depending on the position of linkage 146. Given a kinematic model of blade 142 and linkage 146 (e.g., formula(s) or table(s) providing a relationship between the position and/or movement of portions of blade 142 and linkage 146) and the state of blade 142 and linkage 146 (e.g., sensor(s) sensing one or more positions, angles, or orientations of blade 142 or linkage 146, such as sensor 149), at least with respect to blade lift, controller 138 may compensate for such non-linearity. Incomplete or simplified kinematic models may be used if there is a need to only focus on particular motion relationships (e.g., only those affecting blade lift) or if only limited compensation accuracy is desired. Controller 138 may utilize this compensation and a desired velocity, for example a command to raise blade 142 at a particular vertical velocity, to issue a command that may achieve a flow rate into lift cylinders 150 that results in blade 142 being raised at the particular vertical velocity regardless of the current position of linkage 146. For example, controller 138 may issue commands which vary the flow rate into lift cylinders 150 in order to achieve a substantially constant vertical velocity of blade 142.

Similarly, due to the positioning of tilt cylinder 152 and angle cylinders 154 and the configuration of their connection to blade 142, the angular velocity of blade tilt and angle is not perfectly proportional to the linear velocity of tilt cylinder 152 and angle cylinders 154, respectively, and the angular velocity of tilt and angle may vary even when the linear velocity of tilt cylinder 152 and angle cylinders 154, respectively, is constant. This also means that tilt cylinder 152 and angle cylinders 154 each has a mechanical advantage which varies depending on the position of blade 142. Much like with lift cylinders 150, given a kinematic model of blade 142 and linkage 146, and the state of blade 142 and linkage 146, at least with respect to blade tilt and angle, controller 138 may compensate for such non-linearity. Incomplete or simplified kinematic models may be used if there is a need to only focus on particular motion relationships (e.g., only those affecting blade tilt and angle) or if only limited compensation accuracy is required. Controller 138 may utilize this compensation and a desired angular velocity, for example a command to tilt or angle blade 142 at a particular angular velocity, to issue commands that may vary the flow rate into tilt cylinder 152 or angle cylinders 154 to result in blade 142 being tilted or angled at the particular angular velocity regardless of the current position of blade 142 or linkage 146.

In alternative embodiments, blade 142 may be connected to the remainder of work vehicle 100 in a manner which tends to make the blade lift velocity (in direction of vertical 110), tilt angular velocity (in the direction of roll 104), or angle angular velocity (in the direction of yaw 112) proportional to the linear velocity of lift cylinders 150, tilt cylinder 152, or angle cylinders 154, respectively. This may be achieved with particular designs of linkage 146 and positioning of the pivotal connections of lift cylinders 150, tilt cylinder 152, and angle cylinders 154. In such alternative embodiments, controller 138 may not need to compensate for non-linear responses of blade 142 to the actuation of lift cylinders 150, tilt cylinder 152, and angle cylinders 154, or the need for compensation may be reduced.

Each of lift cylinders 150, tilt cylinder 152, and angle cylinders 154 is a double acting hydraulic cylinder. One end of each cylinder may be referred to as a head end, and the end of each cylinder opposite the head end may be referred to as a rod end. Each of the head end and the rod end may be fixedly connected to another component or, as in this embodiment, pivotally connected to another component, such as a through a pin-bushing or pin-bearing coupling, to name but two examples of pivotal connections. As a double acting hydraulic cylinder, each may exert a force in the extending or retracting direction. Directing pressurized hydraulic fluid into a head chamber of the cylinders will tend to exert a force in the extending direction, while directing pressurized hydraulic fluid into a rod chamber of the cylinders will tend to exert a force in the retracting direction. The head chamber and the rod chamber may both be located within a barrel of the hydraulic cylinder, and may both be part of a larger cavity which is separated by a movable piston connected to a rod of the hydraulic cylinder. The volumes of each of the head chamber and the rod chamber change with movement of the piston, while movement of the piston results in extension or retraction of the hydraulic cylinder. The control of these cylinders will be described in further detail with regard to FIG. 2.

Figure 2:
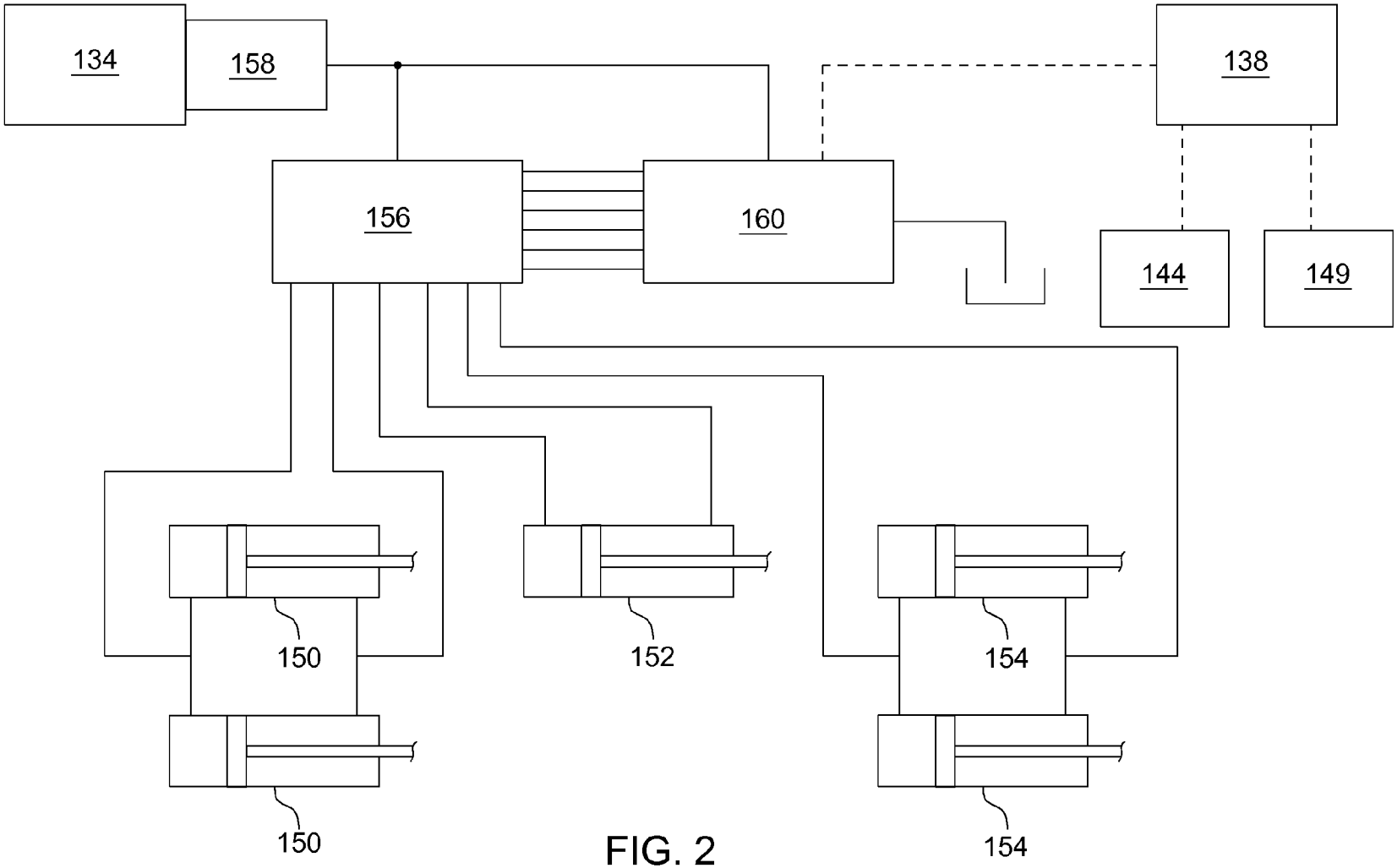
FIG. 2 is a schematic of a portion of the hydraulic and electrical system of the crawler dozer.

FIG. 2 is a schematic of a portion of a system for controlling the hydraulic cylinder, the system including hydraulic and electrical components. Each of lift cylinders 150, tilt cylinder 152, and angle cylinders 154 is hydraulically connected to hydraulic control valve 156, which may be positioned in an interior area of work vehicle 100. Hydraulic control valve 156 may also be referred to as a valve assembly or manifold. Hydraulic control valve 156 receives pressurized hydraulic fluid from hydraulic pump 158, which may be rotationally connected to engine 134, and directs such fluid to lift cylinders 150, tilt cylinder 152, angle cylinders 154, and other hydraulic circuits or functions of work vehicle 100. Hydraulic control valve 156 may meter such fluid out, or control the flow rate of hydraulic fluid to each hydraulic circuit to which it is connected. In alternative embodiments, hydraulic control valve 156 may not meter such fluid out but may instead only selectively provide flow paths to these functions while metering is performed by another component (e.g., a variable displacement hydraulic pump) or not performed at all. Hydraulic control valve 156 may meter such fluid out through a plurality of spools, whose positions control the flow of hydraulic fluid, and other hydraulic logic. The spools may be actuated by solenoids, pilots (e.g., pressurized hydraulic fluid acting on the spool), the pressure upstream or downstream of the spool, or some combination of these and other elements.

In the embodiment illustrated in FIG. 1, the spools of hydraulic control valve 156 are shifted by pilots whose pressure is controlled, at least in part, by electrohydraulic pilot valve 160 in communication with controller 138. Electrohydraulic pilot valve 160 is positioned within an interior area of work vehicle 100 and receives pressurized hydraulic fluid from a hydraulic source and selectively directs such fluid to pilot lines hydraulically connected to hydraulic control valve 156. In this embodiment hydraulic control valve 156 and electrohydraulic pilot valve 160 are separate components, but in alternative embodiments the two valves may be integrated into a single valve assembly or manifold. In this embodiment, the hydraulic source is hydraulic pump 158. In alternative embodiments, a pressure reducing valve may be used to reduce the pressure of pressurized hydraulic fluid provided by hydraulic pump 158 to a set pressure, for example 600 pounds per square inch, for usage by electrohydraulic pilot valve 160. In the embodiment illustrated in FIG. 2, individual valves within electrohydraulic pilot valve 160 reduce the pressure from the received hydraulic fluid via solenoid-actuated spools which may drain hydraulic fluid to a hydraulic reservoir. In this embodiment, controller 138 actuates these solenoids by sending a specific current to each (e.g., 600 mA). In this way, controller 138 may actuate blade 142 by issuing electrical commands signals to electrohydraulic pilot valve 160, which in turn provides hydraulic signals (pilots) to hydraulic control valve 156, which shift spools to direct hydraulic flow from hydraulic pump 158 to actuate lift cylinders 150, tilt cylinder 152, and angle cylinders 154. In this embodiment, controller 138 is in direct communication with electrohydraulic pilot valve 160 via electrical signals sent through a wire harness and is indirectly in communication with hydraulic control valve 156 via electrohydraulic pilot valve 160.

Controller 138, which may be referred to as a vehicle control unit (VCU), is in communication with a number of components on work vehicle 100, including hydraulic components such as electrohydraulic pilot valve 160, electrical components such as operator inputs within operator station 136, sensor 144, sensor 149, and other components. Controller 138 is electrically connected to these other components by a wiring harness such that messages, commands, and electrical power may be transmitted between controller 138 and the remainder of work vehicle 100. Controller 138 may be connected to some of these sensors or other controllers, such as an engine control unit (ECU), through a controller area network (CAN). Controller 138 may then send and receive messages over the CAN to communicate with other components on the CAN.

In alternative embodiments, controller 138 may send a command to actuate blade 142 in a number of different manners. As one example, controller 138 may be in communication with a valve controller via a CAN and may send command signals to the valve controller in the form of CAN messages. The valve controller may receive these messages from controller 138 and send current to specific solenoids within electrohydraulic pilot valve 160 based on those messages. As another example, controller 138 may actuate blade 142 by actuating an input in operator station 136. For example, an operator may use a joystick to issue commands to actuate blade 142, and the joystick may generate hydraulic pressure signals, pilots, which are communicated to hydraulic control valve 156 to cause the actuation of blade 142. In such a configuration, controller 138 may be in communication with electrical devices (e.g., solenoids, motors) which may actuate a joystick in operator station 136. In this way, controller 138 may actuate blade 142 by actuating these electrical devices instead of communicating signals to electrohydraulic pilot valve 160.

Figure 3:
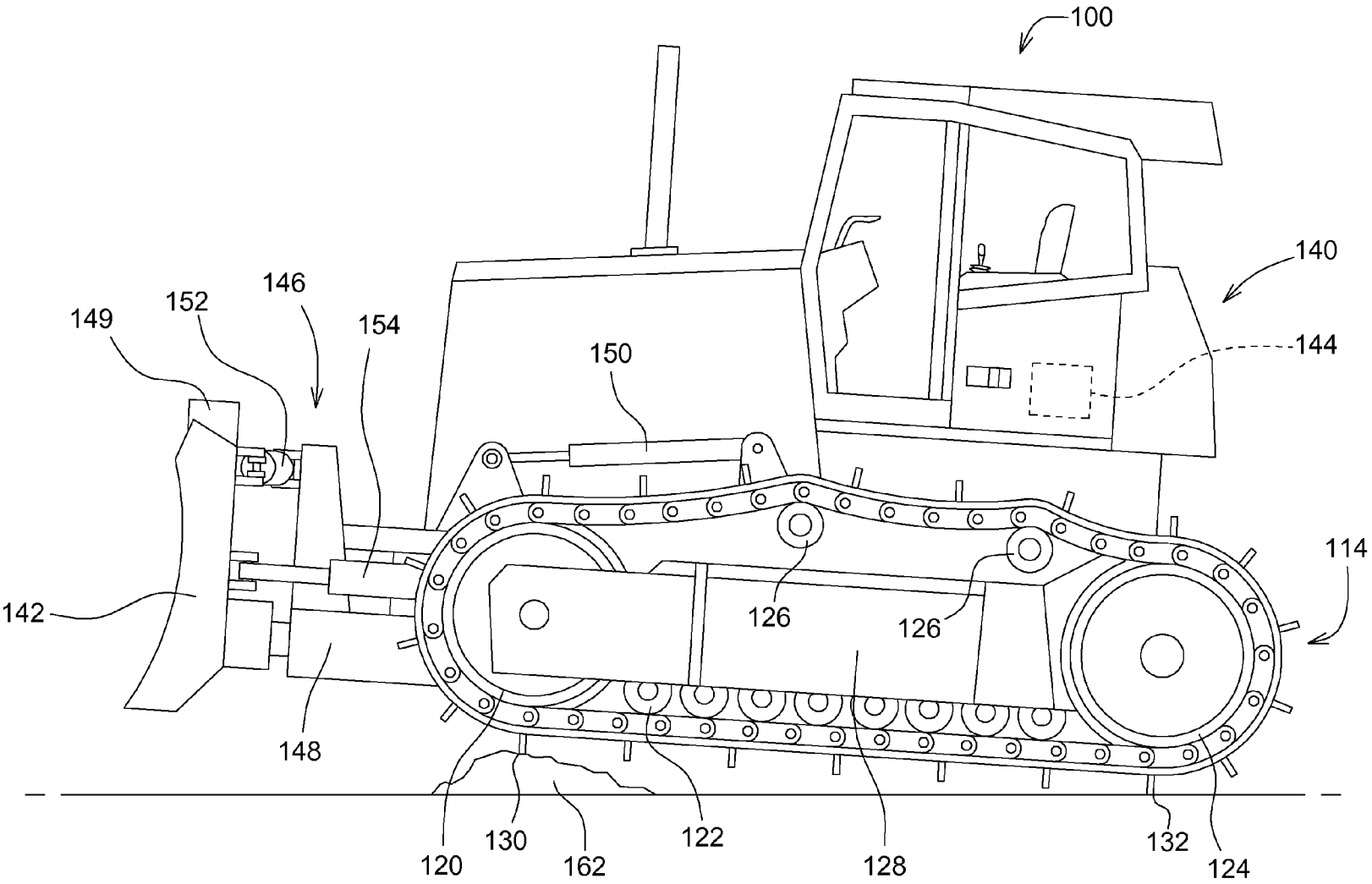
FIG. 3 is a left side view of the crawler dozer driving over a ground feature.

FIG. 3 is a left side view of work vehicle 100 as work vehicle 100 drives over ground feature 162, which in this example is a ground feature at a higher elevation than the surrounding ground surface (e.g., an upward ground feature). As work vehicle 100 drives over ground feature 162, frontmost engaging point 130 is the first point on left track 116 and right track 118 which substantially engages ground feature 162. As work vehicle 100 engages ground feature 162 at frontmost engaging point 130, work vehicle 100 begins to pitch upward or pitch backward as the front of work vehicle 100 rises on ground feature 162 relative to the rear of work vehicle 100. When pitching upwards or backwards, work vehicle 100 will tend to pitch about rearmost engaging point 132. During this pitching, sensor 144 may send a chassis inclination signal indicative of the angle of chassis 140 relative to the direction of gravity (i.e., orientation in the direction of pitch 108) as well as a chassis pitch signal indicative of an angular velocity of chassis 140 in the direction of pitch 108. The chassis inclination signal and chassis pitch signal will indicate an inclination and velocity in a first direction, angled and pitching upwards, as opposed to the chassis inclination signal and chassis pitch signal indicating an inclination and velocity in a second direction, angled and pitching downwards. In this embodiment, chassis inclination signal and chassis pitch signal from sensor 144 to controller 138 may indicate values within a range for which values in one half of the range indicate angles and angular velocities in the first direction and values in the other half of the range indicate angles and angular velocities in the second direction.

Similarly, sensor 149 may send a blade inclination signal indicative of the angle of blade 142 relative to the direction of gravity (i.e., orientation in the direction of pitch 108) as well as a blade pitch signal indicative of an angular velocity of blade 142 in the direction of pitch 108. The blade inclination signal and blade pitch signal will indicate an inclination and velocity in a first direction, angled and pitching upwards, as opposed to the blade inclination signal and blade pitch signal indicating an inclination and velocity in a second direction, angled and pitching downwards. In this embodiment, blade inclination signal and blade pitch signal from sensor 149 to controller 138 may indicate values within a range for which values in one half of the range indicate angles and angular velocities in the first direction and values in the other half of the range indicate angles and angular velocities in the second direction.

As work vehicle 100 continues to drive over ground feature 162, frontmost engaging point 130 would cease to engage the ground and instead would remain suspended above the ground by a distance determined in part by the height of ground feature 162 relative to the surrounding ground surface and the position of work vehicle 100 on ground feature 162. At this point, although ground feature 162 is an upward ground feature, it has the effect of a downward ground feature at a lower elevation than the surrounding ground surface. Specifically, the area just past ground feature 162 is lower than ground feature 162. As the center of gravity for work vehicle 100 passes over the top of ground feature 162, work vehicle 100 will pitch forwards and rearmost engaging point 132 will leave the ground surface while frontmost engaging point 130 will fall until it contacts the ground surface.

During the process of work vehicle 100 driving over ground feature 162, blade 142 will rise and fall relative to the ground surface due to the pitching of work vehicle 100. As work vehicle 100 pitches backward, blade 142 will rise as c-frame 148 pitches backward with work vehicle 100, and as work vehicle 100 pitches forward, blade 142 will fall as c-frame 148 pitches forward with work vehicle 100. If the operator of work vehicle 100 fails to correct for ground feature 162 by commanding blade 142 to rise or fall in a manner that counteracts the effect of ground feature 162 on the height of blade 142, work vehicle 100 will create vertical variations on the ground surface instead of a smooth surface, such as a hill and a valley. As work vehicle 100 drives over this newly created hill and valley on the ground surface, blade 142 will once again be raised and lowered as work vehicle 100 pitches backward and forward, creating further vertical variations. This series of hills and valleys may be referred to as a "washboard" pattern. In addition to creating this pattern, the pitching of work vehicle 100 will also interrupt efforts to maintain a uniform grade. An operator of work vehicle 100 may target a particular grade (e.g., 2%) and if traveling up or down the grade, the pitching of work vehicle 100 will create segments where the actual grade is steeper or shallower than the target grade.

While this is occurring, sensor 144 and sensor 149 send the chassis inclination signal, chassis pitch signal, blade inclination signal, and blade pitch signal to controller 138. Controller 138 may also receive signals from controls in operator station 138 which the operator may use to issue commands, for example a command to raise or lower blade 142. If controller 138 does not sense a command from the operator to raise or lower blade 142, but receives a signal from sensor 144 or sensor 149 indicating that chassis 140 or blade 142 is pitching, controller 138 may issue a command to electrohydraulic pilot valve 160 to raise or lower blade 142 to counteract the effect from the pitch. In this manner, controller 138 may attempt to mitigate or attenuate the effect of pitching and ground features and thereby create a smoother ground surface, as further described with regard to FIG. 5.

In this embodiment, each of sensor 144 and sensor 149 comprise three accelerometers, each measuring linear acceleration in one of three perpendicular directions, and three gyroscopes, each measuring angular velocity in one of three perpendicular directions. In this way, sensor 144 and sensor 149 may each directly measure linear acceleration or angular velocity in any direction, including the directions of longitude 102, latitude 106, vertical 110, roll 104, pitch 108, and yaw 112. The linear acceleration of each accelerometer may be filtered to remove short term accelerations or otherwise analyzed to determine the direction of gravity, which exerts a constant acceleration of approximately 9.81 meters per square second on sensor 144 and sensor 149. The measurements from the accelerometers and gyroscopes of sensor 144 and sensor 149 may be combined or analyzed together to improve the accuracy and/or reduce the latency with which the direction of gravity may be determined. For example, the accelerometers may measure the direction of gravity with high accuracy over a period of time sufficient to remove the effects of short-term accelerations, while the gyroscopes may measure changes to the direction of the sensor relative to the direction of gravity very quickly but be subject to drift if these changes are integrated to determine the direction and error is allowed to accumulate.

Figure 4:
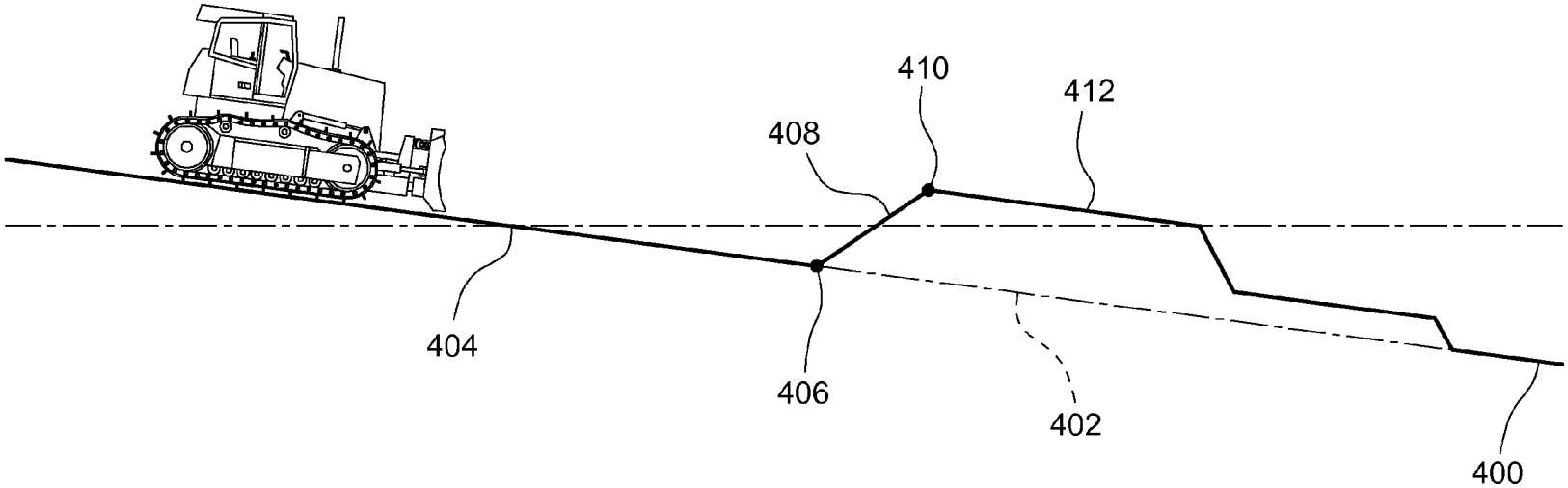
FIG. 4 is an illustration of a ground profile created by the crawler dozer as it drives over ground features.

FIG. 4 illustrates how controller 138 may issue commands to move blade 142 so as to counteract pitching, such as may happen when the tracks of work vehicle 100 engage ground features. As work vehicle 100 travels in a forward direction, it creates profile 400, which illustrates a cross-section of the ground which work vehicle 100 is working. Controller 138 may determine a target grade, including based on an operator directly entering a grade (e.g., 2%) or by recording the current grade after an operator is done issuing blade commands. This target grade, which may also be referred to as a target angle or target plane, is illustrated by line 402 in FIG. 4. While line 402 illustrates the target grade while work vehicle 100 is on slope 404, it does not represent the target grade while work vehicle 100 is on different portions of profile 400.

As work vehicle 100 travels forward, it may create slope 404 which is at the target grade. As work vehicle 100 continues travelling forward, it may encounter a ground feature (e.g., a rock) at point 406, at which point work vehicle 100 will begin pitching upwards. Absent a counteracting command, this may cause blade 142 to pitch upwards and create slope 408, which is at a different grade than target grade 402. Controller 138, receiving chassis inclination signal, chassis pitch signal, blade inclination signal, and blade pitch signal, may detect this change and issue commands to move the blade downwards to counteract the ground feature encountered at point 406. By point 410, controller 138 may have corrected for the ground feature so that blade 142 of work vehicle 100 creates slope 412, which is once again at the target grade. Slope 412 is parallel to slope 404, but at a different elevation due to the increase in elevation by work vehicle 100 overall. If line 402 were updated to reflect the current target slope of work vehicle 100, line 402 would overlay slope 412 while work vehicle 100 was on that portion of profile 400. As work vehicle 100 continues to operate, it may continue to create a series of plateaus and slopes as in encounters ground features and controller 138 commands movement of blade 142 to counteract these ground features.

Figure 5:
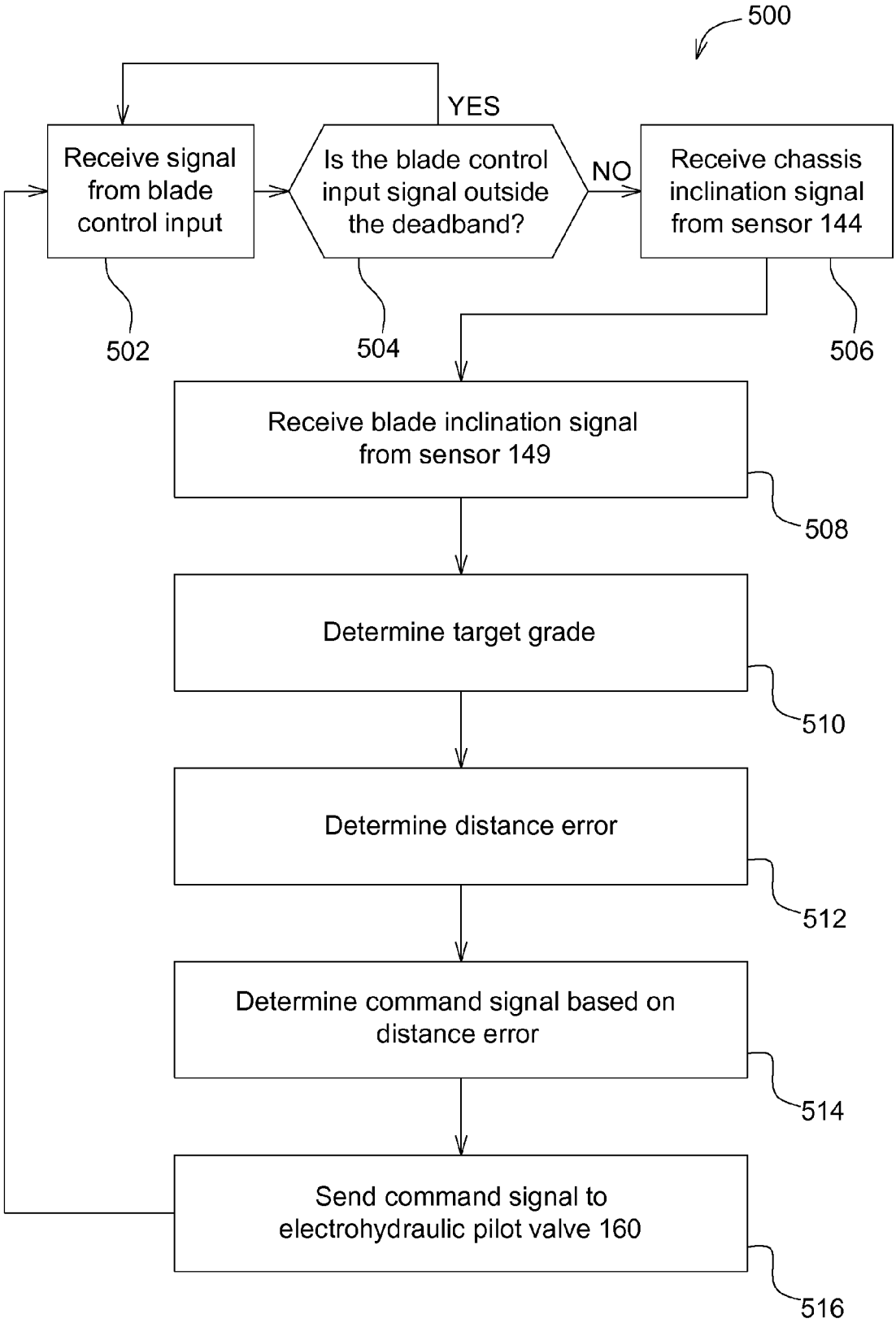
FIG. 5 is a flowchart of a method of actuating a blade of the crawler dozer to create a target grade.

FIG. 5 is a flowchart of control system 500 for actuating blade 142 of work vehicle 100 to create a level ground surface. Control system 500 is implemented on controller 138 of work vehicle 100, and is initiated at the start of work vehicle 100. In alternative embodiments, control system 500 may be initiated by the actuation of an operator control in operator station 136, such as a button or a selection on an interactive display. In step 502, controller 138 receives a signal from a blade control input in operator station 136, such as a joystick that the operator may actuate to issue commands to actuate blade 142. In step 504, controller 138 determines whether the blade control input signal is outside of a deadband by determining whether the signal indicates a command (i.e., blade raise, tilt, or angle) above a threshold. This deadband may be used to avoid unintentional movement of the joystick near it neutral position, which may occur with vibration or work vehicle movement, from being interpreted as a command to actuate blade 142. The size of the deadband, and the corresponding threshold before a command is interpreted as an actual command, may be adjusted and may differ from work vehicle to work vehicle. If controller 138 determines that the blade control input signal is outside of the deadband, controller 138 performs step 502. This loop between step 502 and step 504 effectively suspends control system 500 until the blade control input signal indicates that the operator is not issuing a command.

If the blade control input signal is in the deadband, which indicates that the operator is not issuing a command, controller 138 may perform step 506 next. In step 506, controller 138 receives the chassis inclination signal from sensor 144. As an example, controller 138 may receive a CAN message transmitted from sensor 144 to controller 138 via a wire harness. Controller 138 may be programmed to interpret the CAN message to read a value from 1 to 100, where 1 indicates that chassis 140 is angled 25 degrees forward/downward and 100 indicates that chassis 140 is angled 25 degrees backward/upward.

In step 508, controller 138 receives the blade inclination signal from sensor 149. Much like the chassis inclination signal, controller 138 may receive this signal in the form of a message (CAN or otherwise), voltage, or current which indicates the inclination.

In step 510, controller 138 determines the target grade. The target grade may be determined by a number of different methods. In the embodiment of FIG. 5, the target grade is set to that of a plane intersecting the bottom of the tracks of work vehicle 100 and the bottom of blade 142 after the last blade command by the operator. Thus, the first time that step 510 is performed after step 504 has resulted in a "Yes" (indicating a blade command outside the deadband), controller 138 will determine the current plane and store it as the target grade. If step 510 is performed further times without an intermediate "Yes" in step 504, then controller 138 will retrieve the stored target grade rather than recalculating it.

To determine the target grade, controller 138 utilizes the chassis inclination signal in the embodiment of FIG. 5. The target grade is found by filtering the chassis inclination signal to determine a value about which it trends over the long term, such as by applying a first order low pass filter to the chassis inclination signal. In one embodiment, a first order low pass filter can be used with the time constant of this filter based on the ground speed of work vehicle 100, which may aid in rendering the filter response effectively constant with regard to distance traveled. By based the target grade on a filter of the chassis inclination signal, the target grade can be made to track slow changes in the ground profile. This may be desirable in certain applications, such as a work site where the ground is not truly flat and a constant target grade may not be desirable. In another embodiment, the filter constant can be by changed based on commands given by the operator so that the target grade can be adjusted more rapidly when the operator provides commands of a significant magnitude. Such an embodiment may be desirable if a quick transition is necessary, such as when work vehicle 100 is transitioning up a slope.

First, controller 138 utilizes the chassis inclination signal and the longitudinal distance between a point on the bottom of the tracks of work vehicle 100 and the point on linkage 146 about which blade 142 pivots in the direction of pitch 108 relative to chassis 140. This longitudinal distance may be stored by the manufacturer of work vehicle 100 or the value may be later programmed into work vehicle 100.

In alternative embodiments, the target grade may be set directly by an operator. For example, an operator may set the target grade by entering a target grade of 2% on an interactive display, buttons, or other operator inputs in operator station 136. In such embodiments, controller 138 would merely retrieve this value in step 510.

In step 512, controller 138 determines the distance between the cutting edge of blade 142, the edge which engages the ground, and the location where blade 142 would intersect the target grade determined in step 510, which may be referred to as the distance error. This error may be calculated through the usage of two components, the chassis error and the blade error. The chassis error may be calculated by determining the longitudinal distance between a reference point and the pivotal connection of c-frame 148 to chassis 140, and multiplying this value by the sine of the difference between the angle of the target grade and the chassis inclination signal. The reference point may be a point about which work vehicle 100 is expected to pitch, which may be frontmost engaging point 130, rearmost engaging point 132, or the center of gravity for work vehicle 100, depending on the type of ground feature work vehicle 100 is traversing and in what direction work vehicle 100 is traveling. Alternatively, a constant reference point may also be used, which may, for example, be the average longitudinal position of frontmost engaging point 130, rearmost engaging point 132, or the center of gravity for work vehicle 100. The chassis error calculation results in a vertical error attributable to the angle of chassis 140 compared to the target grade. The blade error may be calculated by multiplying the distance from the pivotal connection of c-frame 148 to chassis 140 by the sine of the difference between the blade inclination signal and the chassis inclination signal. The blade error calculation results in a vertical error attributable to the position of blade 142 relative to chassis 140. The summation of the chassis error and the blade error thus results in the distance error, which is the perpendicular distance from the target grade to the cutting edge of blade 142.

In an alternative embodiment, a target height may be set to a height off the target grade. This may be desirable in certain applications where blade 142 is desired to follow the target grade, but at a set offset from the target grade. In these embodiments, the distance error may be calculated as the difference between the target height and the summation of the chassis error and the blade error.

In step 514, controller 138 determines a command signal based on the distance error determined in step 512. In the embodiment of FIG. 5, the command signal is determined by multiplying the distance error by a gain, making the command signal proportional to the distance error. In alternative embodiments, the command signal may be based on a PID (proportional-integrative-derivative) control, a lookup table which stores certain command signals for certain distance errors, equations, or other methods. The command signal may also be determined using more than distance error as an input, as is described further with regard to FIG. 6.

The gain used in step 514 may be static, or it may be dynamically determined based on certain characteristics of work vehicle 100 (e.g., weight, track length, longitudinal length from center of gravity to ground-engaging edge of blade, maximum blade lift or lower speed), the area being worked by work vehicle 100 (e.g., sandy soil, moisture content, compact level), or measurements of work vehicle 100 (e.g., travel speed or acceleration, travel direction, hydraulic oil temperature, hydraulic pump availability), to name but a few possibilities. The gain may also be adjustable, such as by an operator who may increase or decrease the aggressiveness of control system 500 by increasing or decreasing a value through an interactive display or by actuating one or more buttons.

In step 516, controller 138 sends the command signal determined in step 514 to electrohydraulic pilot valve 160. The command signal sent to electrohydraulic pilot valve 160 may take the form of a CAN message sent to a valve controller associated with electrohydraulic pilot valve 160, or a current or voltage sent to a solenoid within electrohydraulic pilot valve 160. This command signal may be used to change the pressure of one or more pilots from electrohydraulic pilot valve 160 to hydraulic control valve 156, and thereby change the metering of hydraulic fluid to a hydraulic function such as lift cylinders 150 to raise or lower blade 142. This allows controller 138 to actuate blade 142 to counteract the effects of the ground feature on the position of blade 142 relative to the target grade.

Figure 6:
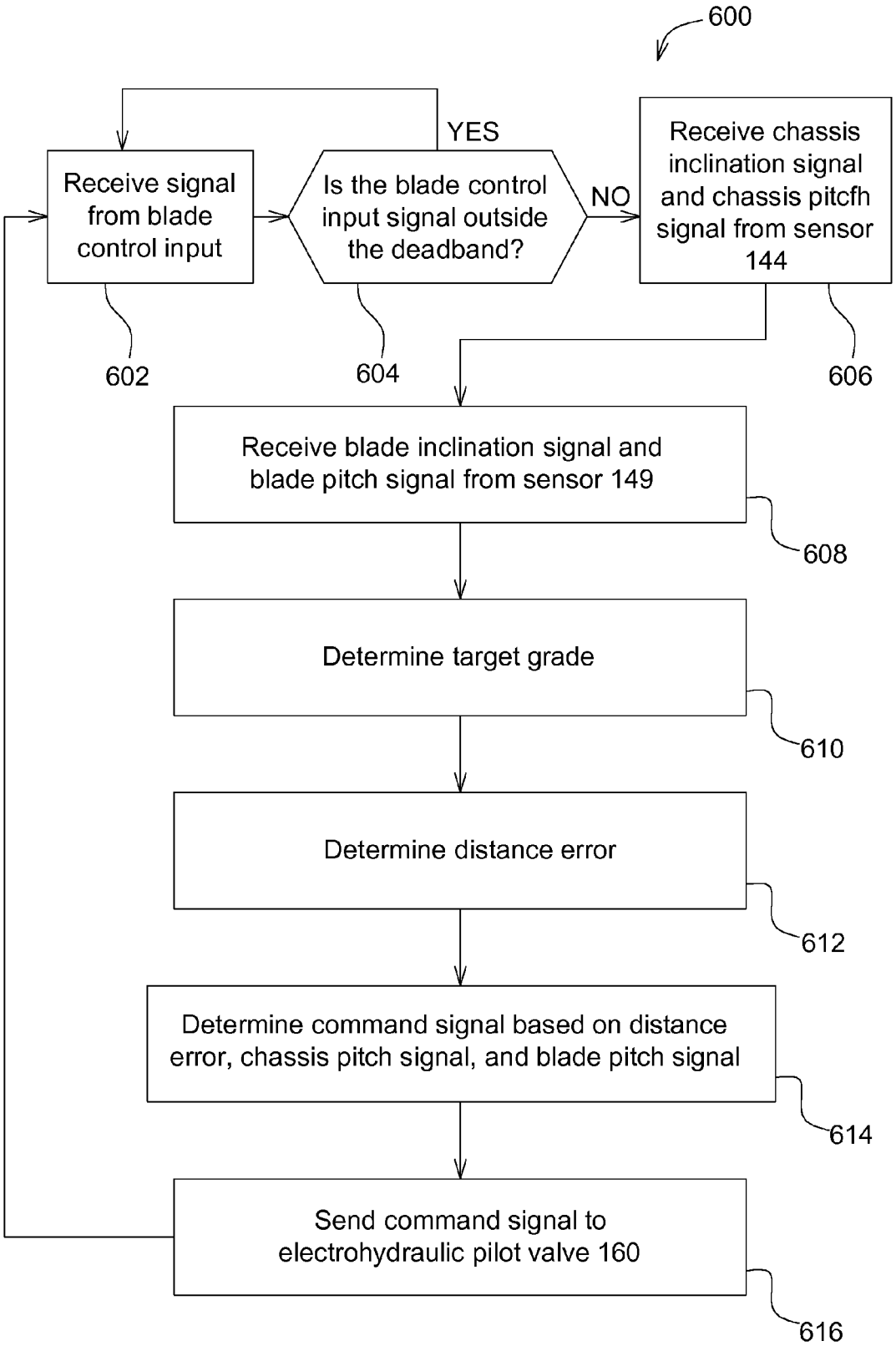
FIG. 6 is a flowchart of another method of actuating the blade of the crawler dozer to create a target grade.

FIG. 6 is a flowchart of control system 600 for actuating blade 142 of work vehicle 100 to create a level ground surface. In step 602, controller 138 receives a signal from a blade control input in operator station 136, such as a joystick that the operator may actuate to issue commands to actuate blade 142. In step 604, controller 138 determines whether the blade control input signal is outside of a deadband. If controller 138 determines that the blade control input signal is outside of the deadband, controller 138 performs step 602.

If the blade control input signal is in the deadband, which indicates that the operator is not issuing a command, controller 138 may perform step 606 next. In step 606, controller 138 receives the chassis inclination signal and chassis pitch signal from sensor 144. As an example, controller 138 may receive a CAN message transmitted from sensor 144 to controller 138 via a wire harness. Controller 138 may be programmed to interpret the CAN message to read two values from 1 to 100, where 1 for the first value indicates that chassis 140 is angled 25 degrees forward/downward and 100 indicates that chassis 140 is angled 25 degrees backward/upward, and 1 for the second value indicates that chassis 140 is pitching 50 degrees a second forward/downward and 100 indicates pitching 50 degrees a second backward/upward.

In step 608, controller 138 receives the blade inclination signal and blade pitch signal from sensor 149. Much like the chassis inclination signal and chassis pitch signal, controller 138 may receive these signals in the form of messages (CAN or otherwise), voltages, or currents which indicate the inclination or pitch.

In step 610, controller 138 determines the target grade. In the embodiment of FIG. 6, the target grade may be directly input by an operator of work vehicle 100 or the operator may chose to have the target grade automatically set by a grade control system. The operator may directly input the target grade (e.g., 2%) into an interactive display within operator station 136, or the operator may enable the grade control system (e.g., by actuating a button). If the grade control system is enabled, it may receive signals from satellites or local positioning beacons from which it can determine the current location of work vehicle 100. The grade control system may then reference a site plan or equivalent location-grade reference to determine the appropriate grade for the current location of work vehicle 100. This grade from the site plan may then be communicated to controller 138 by the grade control system, and controller 138 may store it as the target grade.

In step 612, controller 138 determines the distance between the cutting edge of blade 142, the edge which engages the ground, and the location where blade 142 would intersect the target grade determined in step 610, which may be referred to as the distance error. The distance error may be determined in a similar manner to how it is determined in step 512 for control system 500.

In step 614, controller 138 determines a command signal based on the distance error determined in step 512, the chassis pitch signal received in step 606, and the blade pitch signal received in step 608. In the embodiment of FIG. 6, the command signal is determined by multiplying a first gain by the distance error, multiplying a second gain by the greater of the chassis pitch signal or the blade pitch signal, and summing the two values. In an alternative embodiment, the distance error may be multiplied by a gain which is dependent on the speed of work vehicle 100 and this value may be summed with chassis pitch signal multiplied by a gain which may be based on the direction of travel or speed of work vehicle 100. In yet other alternative embodiments, the command signal may be based on a PID (proportional-integrative-derivative) control applied to some combination of distance error, chassis pitch signal, and blade pitch signal, a lookup table which stores certain command signals for certain distance errors, chassis pitch signals, and blade pitch signals, equations involving all three inputs, or other methods.

Similar to the gain used in step 514, the first gain and the second gain used in step 614 may be static, dynamically determined based on one or more factors, and/or user-adjustable.

In step 616, controller 138 sends the command signal determined in step 614 to electrohydraulic pilot valve 160. This command signal may be used to change the pressure of one or more pilots from electrohydraulic pilot valve 160 to hydraulic control valve 156, and thereby change the metering of hydraulic fluid to a hydraulic function such as lift cylinders 150 to raise or lower blade 142. This allows controller 138 to actuate blade 142 to counteract the effects of the ground feature on the position of blade 142 relative to the target grade.

While the disclosure has been illustrated and described in detail in the drawings and foregoing description, such illustration and description is not restrictive in character, it being understood that illustrative embodiment(s) have been shown and described and that all changes and modifications that come within the spirit of the disclosure are desired to be protected. Alternative embodiments of the present disclosure may not include all of the features described yet still benefit from at least some of the advantages of such features. Those of ordinary skill in the art may devise their own implementations that incorporate one or more of the features of the present disclosure and fall within the spirit and scope of the appended claims.

What is claimed is:

1. A work vehicle comprising:

a chassis;

a ground-engaging blade movably connected to the chassis via a linkage assembly configured to allow the blade to be raised and lowered relative to the chassis;

a sensor assembly, the sensor assembly configured to provide a chassis inclination signal indicative of an angle of the chassis relative to the direction of gravity, the sensor assembly configured to provide a blade inclination signal indicative of an angle of the blade relative to one of the chassis and the direction of gravity; and a controller configured to:

receive the chassis inclination signal;

receive the blade inclination signal;

determine a target grade;

determine a first relative distance between a point on the linkage assembly and the target grade based on the chassis inclination signal;

determine a second relative distance between a point on the blade and the point on the linkage assembly based on the blade inclination signal;

determine a distance error based on the chassis inclination signal, the blade inclination signal, the first relative distance, and the second relative distance, the distance error indicative of a distance between the blade and the target grade; and send a command to move the blade toward the target grade based on the distance error.

2. The work vehicle of claim 1, wherein the point on the linkage assembly is a point about which the linkage assembly pivots relative to the chassis and the point on the blade is a point on a ground-engaging cutting edge of the blade.

3. The work vehicle of claim 1, wherein the controller is further configured to receive a target height indicative of a height above the target grade and determine the distance error based on the first relative distance, the second relative distance, and the target height.

4. The work vehicle of claim 1, wherein the sensor assembly is further configured to provide a chassis pitch signal indicative of a rotational velocity of the chassis in a pitch direction and the controller is further configured to send a command to move the blade toward the target grade based on the distance error and the chassis pitch signal.

5. The work vehicle of claim 4, wherein the controller is further configured to send a command to move the blade toward the target grade based on a first gain applied to the distance error and a second gain applied to the chassis pitch signal.

6. The work vehicle of claim 1, wherein the sensor assembly comprises a first sensor and a second sensor, the first sensor is connected to the chassis at a fixed relative position to the chassis and configured to provide the chassis inclination signal, and the second sensor is connected to the blade at a fixed relative position to the blade and configured to provide the blade inclination signal.

7. The work vehicle of claim 6, wherein at least one of the first sensor and the second sensor comprise at least one accelerometer and at least one gyroscope.

8. The work vehicle of claim 1, wherein the controller is further configured to determine the target grade based on a grade input by an operator.

9. The work vehicle of claim 1, wherein the controller is further configured to receive a blade command signal from an operator input and determine the target grade based on the chassis inclination signal and blade inclination signal after the most recent blade command signal.

10. The work vehicle of claim 1, wherein the controller is further configured to determine the target grade based on a signal from a satellite-based navigation system or a local positioning system.

11. A method of controlling a ground-engaging blade of a work vehicle comprising:

receiving a chassis inclination signal indicative of an angle of a chassis of the work vehicle relative to the direction of gravity;

receiving a blade inclination signal indicative of an angle of the blade relative to one of the chassis and the direction of gravity;

determining a target grade;

determining a first relative distance between a point on a linkage assembly connecting the blade to the chassis and the target grade based on the chassis inclination signal;

determining a second relative distance between a point on the blade and the point of the linkage assembly based on the blade inclination signal;

determining a distance error indicative of a distance between the blade and the target grade based on the chassis inclination signal, the blade inclination signal, the first relative distance, and the second relative distance; and determining a command signal to direct movement of the blade toward the target grade based on the distance error.

12. The method of claim 11, wherein the distance error is not determined based on a signal received from a satellite navigation system.

13. A crawler-dozer comprising:

a chassis;

a ground-engaging blade movably connected to the chassis by a linkage assembly configured to allow the blade to be raised and lowered relative to the chassis;

a hydraulic cylinder;

an electrohydraulic valve assembly configured to move the blade by directing hydraulic fluid to the hydraulic cylinder;

a first sensor connected to the chassis at a fixed relative position to the chassis, the first sensor configured to provide a chassis inclination signal indicative of an angle of the chassis relative to the direction of gravity;

a second sensor connected to the blade at a fixed relative position to the blade, the second sensor configured to provide a blade inclination signal indicative of an angle of the blade relative to one of the chassis and the direction of gravity; and a controller configured to:

receive the chassis inclination signal;

receive the blade inclination signal;

determine a target grade;

determine a first relative distance between a point on the linkage assembly about which the linkage assembly pivots relative to the chassis and the target grade based on the chassis inclination signal;

determine a second relative distance between a point on the blade and the point on the linkage assembly based on the blade inclination signal;

determine a distance error based on the chassis inclination signal, the blade inclination signal, the first relative distance, and the second relative distance, the distance error indicative of a distance between the blade and the target grade;

determine a command signal directing movement of the blade toward the target grade based on the distance error; and send the command signal to the electrohydraulic valve assembly.

14. The crawler-dozer of claim 13, wherein the second sensor is further configured to provide a chassis pitch signal indicative of a rotational velocity of the chassis in a pitch direction and the controller is further configured to send a command to move the blade toward the target grade based on the distance error and the chassis pitch signal.

15. The crawler-dozer of claim 14, wherein at least one of the first sensor and the second sensor comprises at least one accelerometer and at least one gyroscope.

16. The crawler-dozer of claim 13, wherein the controller is further configured to receive a blade command signal from an operator input and determine the target grade based on the chassis inclination signal and blade inclination signal after the most recent blade command signal.

17. The crawler-dozer of claim 13, wherein the controller is further configured to determine distance error based on a kinematic relationship between the blade and the chassis.

* * * * *